United States Patent [19]

Clüsserath

[11] Patent Number: 4,949,764

[45] Date of Patent: Aug. 21, 1990

[54] METHOD FOR FILLING CONTAINERS WITH CARBONATED LIQUID UNDER COUNTERPRESSURE AS DISPENSED HAVING DIFFERENT FILLING CHARACTERISTICS BY ADJUSTING PRESSURE DIFFERENTIAL WITHOUT CHANGING FLOW CONTROL MECHANISM

[75] Inventor: Ludwig Clüsserath, Bad Kreuznach, Fed. Rep. of Germany

[73] Assignee: Seitz Enzinger Noll Maschinenbau Aktiengesellschaft, Mannheim, Fed. Rep. of Germany

[21] Appl. No.: 196,731

[22] Filed: May 20, 1988

[30] Foreign Application Priority Data

May 22, 1987 [DE] Fed. Rep. of Germany ..... 3717256

[51] Int. Cl.[5] ..... B65B 3/18; B67C 3/06

[52] U.S. Cl. ..... 141/6; 141/39; 141/41

[58] Field of Search ..... 141/6, 39, 1, 4, 5, 141/40, 41, 42, 43

[56] References Cited

U.S. PATENT DOCUMENTS

| | | | |
|---|---|---|---|
| 2,810,406 | 10/1957 | Milleville | 141/6 |
| 3,195,585 | 7/1965 | Fechheimer | 141/1 |
| 3,380,488 | 4/1968 | Herbst | 141/6 |
| 3,877,358 | 4/1975 | Karr | 141/6 |
| 3,886,982 | 6/1975 | Uth et al. | 141/39 |
| 4,146,065 | 3/1979 | Borstelmann | 141/5 |
| 4,360,045 | 11/1982 | Ahlers | 141/39 |
| 4,390,048 | 6/1983 | Zelder | 141/6 |
| 4,557,301 | 12/1985 | Jörss | 141/5 |

*Primary Examiner*—Ernest G. Cusick

*Attorney, Agent, or Firm*—Robert W. Becker & Associates

[57] ABSTRACT

A method for filling containers, under counterpressure, with carbonated liquids. The return gas, that is to be withdrawn from a container that is being filled, is conveyed, accompanied by a pressure differerntial, into a return gas chamber via a connection that is provided with a flow control mechanism. In this return gas chamber a pressure is regulated that is adjustable within a range that is between the filling pressure and the critical pressure of the flow control mechanism. In this way, the flow velocity with which the dispensed liquid flows into a container that is being filled can be smoothly adapted in an infinitely variable manner to the filling characteristics of a respectively dispensed liquid, and/or to the respective output requirements of the filling apparatus.

6 Claims, 4 Drawing Sheets

FIG-3
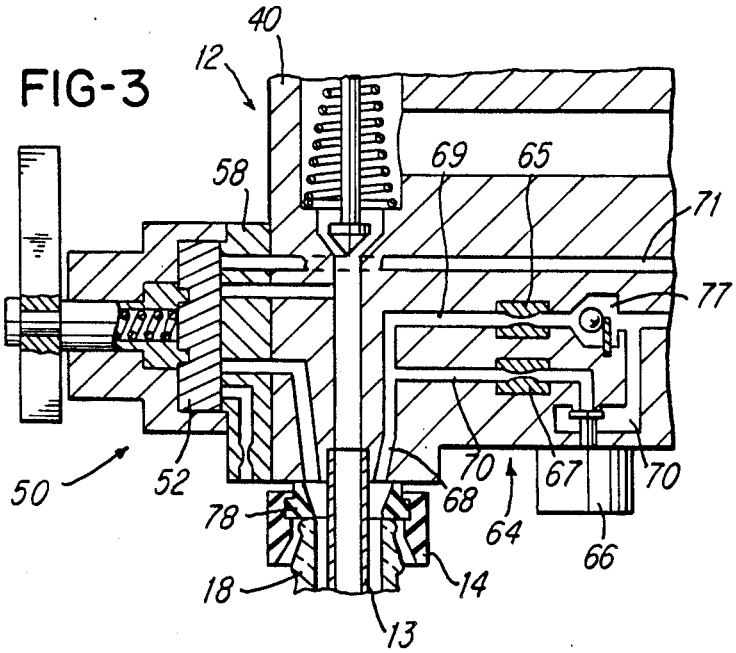
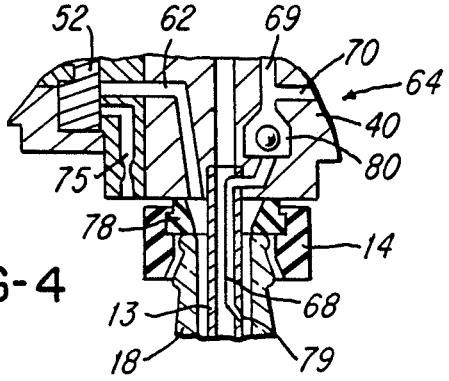
FIG-4

METHOD FOR FILLING CONTAINERS WITH CARBONATED LIQUID UNDER COUNTERPRESSURE AS DISPENSED HAVING DIFFERENT FILLING CHARACTERISTICS BY ADJUSTING PRESSURE DIFFERENTIAL WITHOUT CHANGING FLOW CONTROL MECHANISM

BACKGROUND OF THE INVENTION

The present invention relates to a method for filling a carbonated liquid, especially a beverage, under counterpressure into a bottle or other container.

The withdrawal of return gas, which is in the form of gas or gas mixture and is displaced during the introduction of liquid into a container that is to be filled, is effected with pressure differential into a chamber in order to permit a high flow velocity for rapid filling of containers, resulting in a high filling efficiency of a filling machine This is to be the case regardless of how termination of introduction of liquid is effected, which is undertaken either as a result of the interruption of the withdrawal of return gas due to the rise of the liquid itself in the container, or as a consequence of a signal that is ascertained by a pick-up device as the liquid in the container rises to a predetermined filling height, or after a fixed quantity of liquid has actually been introduced into the container.

A method of the aforementioned general type for filling containers is known from U.S. Pat. No. 4,360,045 Ahlers dated Nov. 23, 1982, belonging to Seitz-Werke GmbH of Bad Kreuznach, West-Germany, where, with a counterpressure filling machine that is provided with a plurality of filling elements, the pressure differential in a container that is to be filled is generated by withdrawing the return gas, via a connecting means that is provided with a flow control mechanism, into a chamber that is embodied as an annular venting channel for all of the filling elements of the filling machine; the return gas is discharged from this chamber, to the atmosphere, via an outlet.

Each filling element of the filling machine is provided with such a connection, which is provided with a flow control mechanism and is associated with a pressurizing gas valve arrangement. The valve control mechanism is provided with one or more nozzles, the fixed diameter of which is such that during introduction of liquid into a container, a pressure is set that at least for a given time period is below the filling pressure at which the liquid that is to be dispensed is supplied to the filling machine and hence to the liquid container thereof and to the filling elements that are disposed on the liquid container. Furthermore, each connection can be blocked off, and each filling element is provided with container relief or venting means so that after termination of introduction of liquid into a container, the pressure in the latter can be reduced to atmospheric pressure, and the container can be removed from the filling element.

Since the cross-sectional throughput area of one or more nozzles of each flow control mechanism is set to the flow velocity that is optimum for the dispensed liquid and type of bottle most frequently used with that filling machine, this flow velocity is not suitable for other liquids that have different filling properties and could also be dispensed with the filling machine, so that for these liquids, for example, wheat beer, often difficult to dispense, considerably reduced outputs result that can, for example, be the result of the excessive development of foam.

SUMMARY OF THE INVENTION

It is therefore an object of the present invention to provide a method via which in an economical manner it is possible to optimally dispense liquids having different filling characteristics by adjusting the pressure differential without having to undertake any changes of the flow control mechanism that is associated with the respective filling element.

BRIEF DESCRIPTION OF THE DRAWINGS

This object, and other objects and advantages of the present invention, will appear more clearly from the following specification in conjunction with the accompanying schematic drawings, in which:

FIG. 3 is a detailed view of the blockable connecting means of the filling element;

FIG. 4 is a further detailed view of a modified blockable connecting means of the filling element.

DETAILED DESCRIPTION

Figure 1:
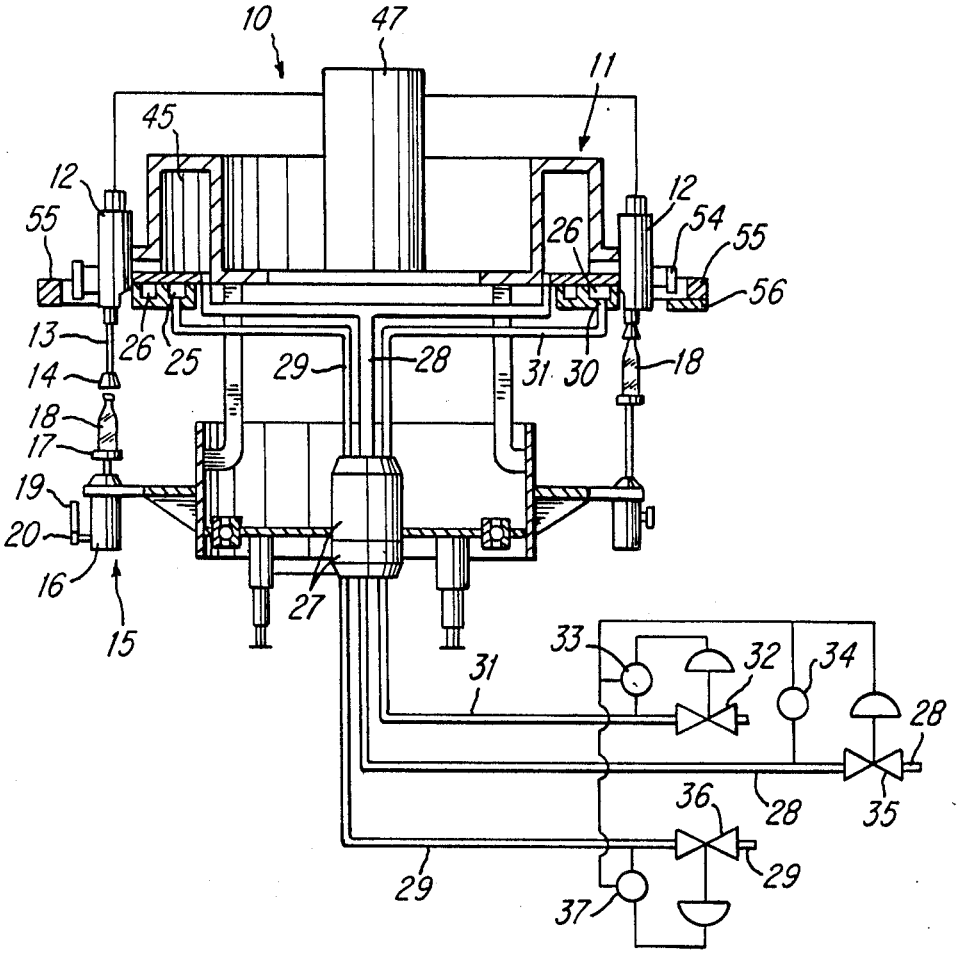
FIG. 1 is a view that diagrammatically illustrates one exemplary embodiment of a multi-chamber counterpressure filling machine where the filling elements are controlled pursuant to the present invention.

The method of the present invention includes the steps of: preliminarily pressurizing a container; introducing, via a filling element the liquid, which is under a filling pressure, into the container when the latter is in a sealing position relative to the filling element; during the introduction of liquid into the container, at least for a given period of time, withdrawing from the container, accompanied by a pressure differential, the gas or gas mixture that is displaced by the introduced liquid, and conveying the gas or gas mixture into a chamber via a connecting means that is provided with a flow control mechanism; regulating in the chamber a pressure that is adjustable within a range that is between the filling pressure and the critical pressure of the flow control mechanism; interrupting the connecting means upon termination of liquid introduction and thereupon reducing pressure in the container to atmospheric pressure.

The method of the present invention is suitable for filling containers with single or multi-chamber counterpressure filling machines, and makes it possible, merely by adjusting the pressure that is regulated in the chamber to a different value that is determined by the filling characteristics of the respectively dispensed liquid, to adapt the pressure differential or flow velocity to the often very different filling characteristics of the liquids t hat are to be dispensed by a filling machine, so that with a single filling machine, it is possible to dispense in an optimum manner not only one type of beverage, but also different kinds of beverages, such as beer, wheat beer, lemonade, mineral water, etc. This implies high dispensing efficiencies without time-consuming alterations of the flow control mechanisms, such as the exchange of nozzles, and is surprisingly possible because, apparently due to the damping effect of the flow control mechanism associated with each filling element, pressure deviations of the pressure that is to be regulated, which deviations are caused by the system and show their effect upon introduction of liquid into the container, have no disruptive impact.

Advantageously, the pressure that is to be regulated in the chamber can correspond to, or be nearly the same as, the saturation pressure of the liquid that is to be dispensed. Furthermore, the pressure that is to be regulated in the chamber can be regulated as a function of the filling pressure of a liquid that is to be dispensed. Expediently, this pressure is regulated continuously as a function of the filling pressure.

The pressure that is to be regulated in the chamber can be effected via the connection that exists between the container and the chamber during a time period provided at the termination of introduction of liquid and while the container is still pressed onto the filling element; after this time period has terminated, the existing connection is interrupted and relief of the container is undertaken. Thus, between the point in time at which the prescribed filling height is achieved, and the point in time that relief of the container is initiated, a time period is provided for calming the dispensed liquid at the regulated pressure, which is below the filling pressure, thereby resulting in a considerably shorter period of time for container relief.

If at least a portion of the gas or gas mixture that is displaced into the chamber via the connection is used for preliminarily pressurizing the container and/or for preliminarily rinsing the container prior to pressurizing, a particularly economical manner of operation is achieved, because by using inert gas, such as $CO_2$, as preliminary pressurizing gas, the displaced gas or gas mixture contains a high proportion of $CO_2$, so that via the inventive further use of the gas or gas mixture, which is under the regulated pressure, for preliminarily rinsing and/or pressurizing, the $CO_2$ consumption of the machine is considerably reduced.

The arrangement for the method of the present invention includes: a liquid container for the liquid that is to be dispensed; a chamber for pressurizing gas; a return gas chamber for gas or gas mixture displaced from a container that is being filled, with this return gas chamber including an outlet that can be opened to the atmosphere; at least one filling element, which includes a long filling tube, a controlled liquid flow valve, and a controlled pressurizing gas valve arrangement, with the filling element being connected to the liquid container, the pressurizing gas chamber, and, via a blockable connecting means of the pressurizing gas valve arrangement, to the return gas chamber, with the connecting means being provided with a flow control mechanism and serving to withdraw displaced gas or gas mixture from the container that is being filled, and with the connecting means being connected to the outlet of the gas chamber; and a regulating valve that is operatively connected to the outlet of the return gas chamber, or to an extension line connected to said outlet, with the regulating valve being adapted to be opened when the pressure that is to be regulated in the return gas chamber is exceeded.

Further specific features of the present invention will be described in detail subsequently.

Referring now to the drawings in detail, FIG. 1 schematically illustrates a counterpressure filling machine, for example a three-chamber counterpressure filling machine 10 of rotating construction for carbonated liquids, especially beverages. The filling machine 10 includes an annular liquid container 11, with a plurality of uniformly spaced-apart filling elements 12 being placed all the way around upon the outer periphery of the liquid container 11. Each filling element 12 is provided with an essentially vertically disposed filling tube 13 and a vertically displaceable centering and sealing mechanism 14. Furthermore associated with each filling element 12 is a raising and lowering mechanism 15 with a lifting cylinder 16 and a support plate 17 for a respective container 18, for example a bottle, that is to be filled. The raising and lowering action can be accomplished in such a way that the lifting cylinders 16 are constantly supplied with pressure medium in the lifting direction, with a cam 19 being disposed in the region of the non-illustrated introduction and ejection for the containers. Guide rollers 20 mounted on the lifting cylinders 16 run on the cam 19 in order to lower each support plate 17 on which rests a filled container 18 prior to ejection, and in order to permit each lowered support plate 17 to receive an empty container 18 at the introduction location and to be raised to the pertaining filling element 12.

Disposed at the bottom of the annular liquid container 11 are not only an annular distribution chamber 25 for pressurizing gas, but also an annular chamber 26 for return gas. Via a central distributor 27 of the filling machine, the liquid container 11 is supplied via a liquid line 28, and the annular distribution chamber 25 is supplied via a pressurizing gas line 29. A regulating valve 32 is connected to the outlet 30 of the return gas chamber 26, or to a line 31 that extends to the outlet 30 and also runs through the distributor 27. A pressure sensor 33, for example a pressure regulator, is associated with the regulating valve 32 upstream thereof and is disposed in the extension line 31 or in the return gas chamber 26. The pressure that is to be regulated in the return gas chamber 26 can be adjusted via the pressure sensor 33. A further pressure sensor 34, for example a pressure regulator, is associated with the pressure sensor 33 and is disposed in the liquid line 28; the pressure sensor 34 controls a further regulating valve 35 that is interposed in the liquid line 28. The pressure that is to be regulated and that is set at the pressure sensor 33 is a function of the filling pressure detected by the further pressure sensor 34 in the liquid line 28 or in the liquid container 11. Provision is made to determine the pressure differential between the pressure detected by the pressure sensor 33 and the pressure detected by the further pressure sensor 34; when this pressure differential exceeds or goes beyond a value more than the pressure that is to be regulated, then the regulating valve 32 is opened by a signal, for example a continuous signal, that is emitted by the pressure sensor 33, with opening of the regulating valve 32 permitting discharge of return gas. In the most straightforward case, however, the pressure sensor 33 can also control the regulating valve 32 itself. The pressure in the annular distribution chamber 25 is similarly regulated as a function of the filling pressure. For this purpose, a regulatable valve 36 is interposed in the pressurizing gas line 29. A sensor 37, for example a pressure regulator, is associated with the valve 36. The sensor 37 is disposed in the pressurizing gas line 29, and is connected with the further pressure sensor 34 in a regulatable manner.

Figure 2:
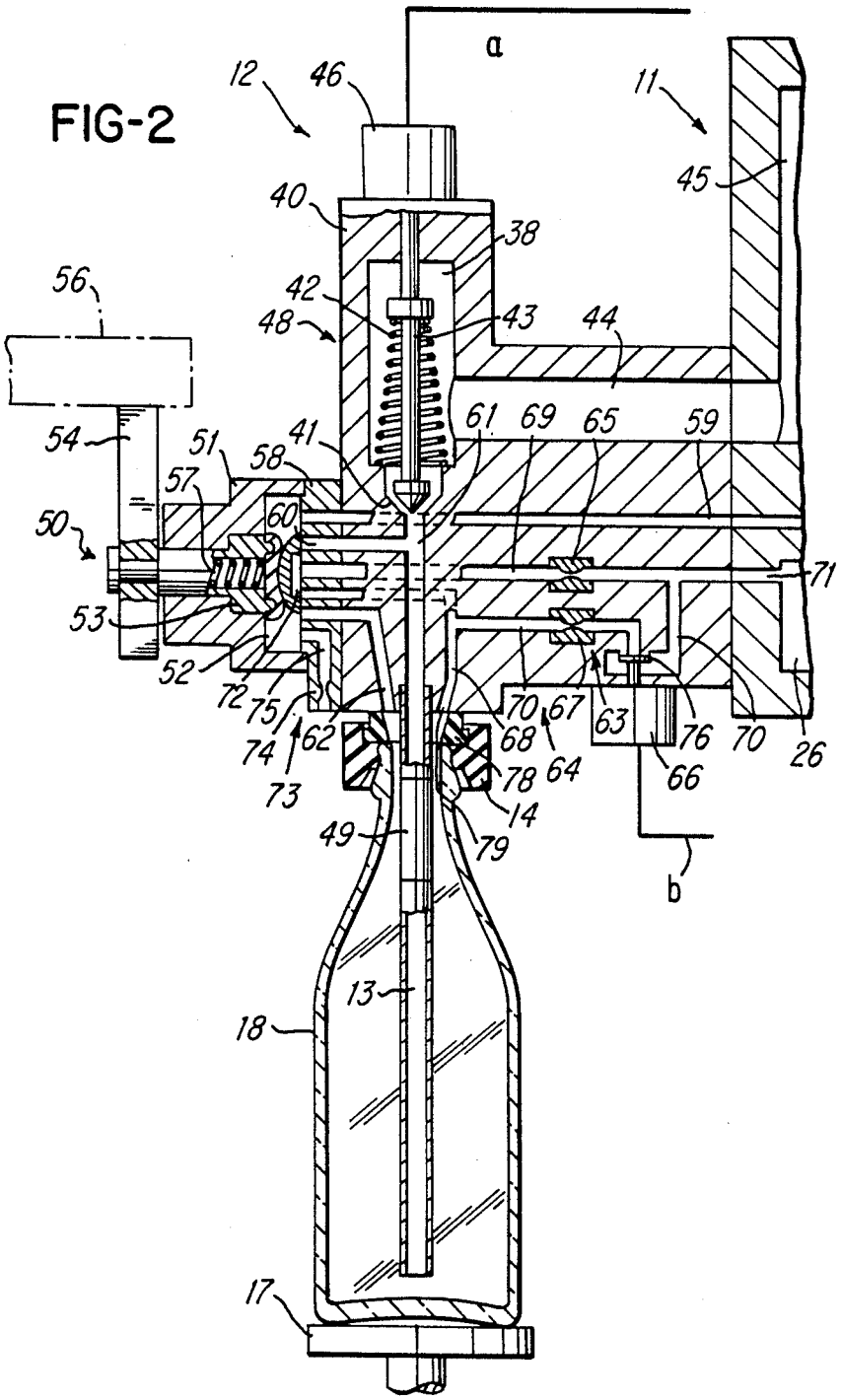
FIG. 2 is an enlarged view of a single filling element of the counterpressure filling machine of FIG. 1.

The diagrammatic view of FIG. 2 shows one of the filling elements 12, which is placed on the annular liquid container 11, in the filling position. The essential construction of the filling elements 12 is known, and each filling element is provided with a valve body 43 that is disposed in a valve chamber 38 of the filling element housing 40, and is raised from a valve seat 41 via an opening spring 42. The valve chamber 38 is connected via a liquid channel 44 to the liquid chamber 45 of the liquid container 11. Disposed on the filling element housing 40 is an electrical or electropneumatic actuating device 46 that is connected via a control line "a" to a central control mechanism 47 of the filling machine 10. When the device 46 is actuated, it presses the valve body 43 against the opening spring 42 onto the valve seat 41, thereby establishing the closure position of the liquid flow valve 48, which comprises the valve seat 41 and the valve body 43.

Inserted into the filling element housing 40, from below, is the filling tube 13, which in a known manner is provided with an electrical switching member 49 that is connected via a nonillustrated signal line to the control mechanism 47. Disposed on the side of the filling element housing 40 is a pressurizing gas valve arrangement 50 in the form of a flat slide valve, in the housing 51 of which is rotatably mounted, via a support 53, a flat valve disk 52. The free end of the support 53, which projects out of the housing 51, is provided with an actuating lever 54 that cooperates during circulation or rotation of the machine with control elements 56, such as control curves or control cams, that are mounted on a control ring 55 of the filling machine 10 (FIG. 1); the control elements 56 are spaced from one another and are disposed at different levels, with these control elements effecting pivoting or turning of the valve disk 52 into the respectively required operating positions. A spring 57 presses the valve disk 52 in a gastight manner against a base plate 58, into that surface of which that faces the valve disk 52 opens the pressurizing gas supply channel 59, which comes from the annular distribution chamber 25 and is conveyed through the lower leg of the liquid container 11 and through the filling element housing 40. Also opening into that surface of the base plate 58 that faces the valve disk 52 are an equalizing channel 60, which is guided into an equalizing chamber 61 formed between the liquid flow valve 48 and the filling tube 13, as well as a pressurizing gas inlet channel 62, which can be connected to the pressurizing gas supply channel 59 via a non-illustrated groove of the valve disk 52. The inlet channel 62 opens out at the lower end of the filling element housing 40, i.e. opens into an annular pressurizing gas chamber that opens out at the lower end.

Starting from the lower end of the filling element housing 40, a connecting means 64 that is provided with a flow control mechanism 63 extends through the housing 40 to the return gas chamber 26. This connecting means 64 on the one hand comprises a supply conduit section 68 that, from an inlet 79 disposed at the lower end of the filling element housing 40, and after an upwardly extending section, is split in a prong-like manner into a conduit section 69 and a further conduit section 70, and on the other hand comprises a withdrawal conduit section 71 that is connected to the return gas chamber 26 and in which the conduit section 69 and the further conduit section 70 are joined after they have extended alone over a sufficient length. A Venturi tube 65 for a slow filling phase is disposed in the conduit section 69, and a further Venturi tube 67 is disposed in the further conduit section 70 for a rapid filling phase that is provided in common with the Venturi tube 65; the two Venturi tubes 65, 67 form the flow control mechanism 63 of the connecting means 64. Ahead of the Venturi tube 65 when viewed in the direction of flow, the conduit section 69 can be blocked off via a control groove 72 of the valve disk 52. By means of this control groove 72, the ends of the conduit section 69 that open out into that surface of the base plate 58 that faces the valve disk 52 can be connected for withdrawing the return gas that is displaced during the filling process. Disposed downstream of the further Venturi tube 67, in the further conduit section 70, is an electrically or electropneumatically actuable discharge valve 66 that is connected to the control mechanism 47 via a control line "b", and that in the closure position interrupts the further conduit section 70 via a valve body 76.

As shown in FIG. 3, the conduit section 69 could also be blocked off via a check valve 77 that is disposed in the section 69 and permits unobstructed discharge of return gas, but automatically prevents back flow of return gas if a bottle breaks or during container relief. By the use of such a check valve 77, for example a ball retaining valve, the switching features that are otherwise required for the valve disk 52 in order to open or block off the conduit section 69, or even the control groove 72 provided in the valve disk 52, are eliminated.

Container relieving means 73 are also provided in the pressurizing gas valve arrangement 50, which additionally includes the connecting means 64 with the flow control mechanism 63. The container relieving means 73 includes a venting channel 75 that is provided with a flow control mechanism 74 and that extends from that surface of the base plate 58 that faces the valve disk 52 into the base plate 58 and downwardly to where it opens out along the outer peripheral surface of the base plate. A non-illustrated channel that is provided in the valve disk 52 connects, in the relief position of the valve disk 52, the equalizing channel 60, the pressurizing gas inlet channel 62, and the venting channel 75.

After the aforementioned filling apparatus, which is in the form of a rotating filling machine 10, is shifted into the operational state for filling a carbonated beverage, such as a beer having a $CO_2$ content of 5.5 g/l and a temperature of 5° C., the actual filling is commenced during rotation of the machine. For dispensing the beer, this operational state includes setting at the further pressure sensor 34 a filling pressure of, for example, 2 bar, at the sensor 37 an initial pressure that is slightly below the filling pressure, and at the pressure sensor 33 a regulatable pressure that is determined as a function of the filling characteristics of the beer and is at a level of 1.25 bar that corresponds to the saturation pressure of the beer and consequently is to be coordinated to the pressure range disposed between the filling pressure that exists in the liquid line 28 or in the liquid container 11, and the critical pressure of the flow control mechanism 63. By way of example, the Venturi tube 65 of the flow control mechanism 63 can have a diameter of 0.7 mm, and the Venturi tube 67 can have a diameter of 0.8 mm. As shown in FIG. 2, for the actual filling each of the containers 8, in the illustrated embodiment a bottle, that is to be filled is brought, along with the interposition of a sealing element 78 of the centering mechanism 14, into a sealing position with the lower end of the housing 40 of the filling element 12. Subsequent to the usual pressurizing with air or an inert gas, which process can in certain cases also be preceded by a preliminary rinsing, there is effected the release of the liquid flow valve 48 as a consequence of a control signal that is issued to the actuating device 46 from the control mechanism 47 via the control line "a", so that via the effect of the opening spring 42, the liquid flow valve 48 is shifted into the open position shown in FIG. 2. At this point in time, for a slow filling phase, the valve disk 52, after the actuating lever 54 has run up against a control element 56, assumes a position in which, via the control groove 72, the conduit section 69 is continuously free, so that during the liquid introduction that has now commenced, the return gas that is displaced from the liquid leaving the bottom end of the filling tube 13 and that is in the form of a gas mixture comprising pressurizing gas and air from the container that is to be filled, enters via the container opening and the sealing element 78 into the supply conduit section 68 of the connecting means 64, whereupon, via the conduit section 69 and the Venturi tube 65 disposed therein, as well as via the withdrawal conduit section 71 of the connecting means 64, the return gas is conveyed into the return gas chamber 26, which is at the pressure that is to be regulated. In so doing, as a function of the cross section of the Venturi tube 65 and of the regulated pressure in the return gas chamber 26, a pressure differential relative to the filling pressure results in the container that is to be filled. At this pressure differential, the liquid slowly exits at a low flow velocity from the lower end of the filling tube 13. If, as the filling element 12 continues to rotate, the liquid rising in the container reaches the bottom end of the filling tube 13, the discharge valve 66, as a consequence of a control signal issued from the control mechanism 47 via the control line "b", is then opened, as a result of which the return gas is now additionally withdrawn via the further Venturi tube 67. In so doing, as a function of the now effective total cross-sectional area of the Venturi tubes 65, 67, and as a function of the regulated pressure in the return gas chamber 26, there results, in the container that is to be filled, a pressure differential relative to the filling pressure, at which pressure differential further introduction of liquid continues at that flow velocity that is optimum for the liquid that is being dispensed. This rapid filling phase terminates when the liquid rises into the narrower portion of the container 18, with termination of this rapid filling phase being effected by shifting the discharge valve 66 into a closed position as a consequence of a control signal issued to the discharge valve 66 from the control mechanism 47 via the control line "b".

As the filling element 12 continues to rotate, and with only the Venturi tube 65 being effective, introduction of liquid continues at a reduced flow velocity until the switching member 49 is actuated at a predetermined filling height, whereupon the control mechanism 47 emits a control signal that, via the control line "a", activates the actuating device 46 and, for closing the liquid flow valve 48, presses the valve body 43, against the opening spring 42, onto the valve seat 41, thereby terminating introduction of liquid. Shortly thereafter, with a liquid that is to be filled and that has good filling characteristics, the actuating lever 54 runs against a control element 56. During the thereby effected pivoting or rotating of the valve disk 52, first, by removing the control groove 72 from an operative connection with the conduit section 69, the latter is interrupted. Shortly thereafter, in order to undertake relief of the container to atmospheric pressure, the valve disk 52 assumes an operational position in which the non-illustrated channel connects the pressurizing gas in the channel 62 and the equalizing channel 60 with the venting channel 75, so that via the latter and the flow control mechanism 74 disposed therein, the pressure that still exists in the filled container 18 is relieved to atmospheric pressure. In so doing, the reciprocal adjustment of the liquid levels within the filling tube and in the container takes place. As the filling element 12 continues to rotate, the relieved container 18 is removed from the filling element by being lowered via the lifting cylinder 16, and is also removed from the machine via the container-ejection mechanism. As a deviation from this procedure, in order to stabilize or calm filled liquid that has a poor filling characteristic, it may be expedient to allow the regulated pressure in the return gas chamber 26 to be effective in the filled container via the still effective conduit section 69 of the connecting means 64 that leads from the liquid introduction for a specified period of time at the termination of the liquid introduction. Only after this period of time has run, is there then undertaken, as previously described, via the rotation of the valve disk 52, first interruption of the conduit section 69 and thereupon, via the operational position assumed by the valve disk 52, the relief of the container and adjustment or equalization of the liquid levels.

If during the previously described operation a different filling characteristic of the liquid that is to be dispensed is to be observed, because for example the temperature and/or the $CO_2$ content of the liquid that is to be dispensed has different values or the type of bottle has been changed, then by changing the previous pressure setting at the pressure sensor 33, the regulated pressure is adapted to the altered filling conditions in order to again achieve an optimum flow velocity that is adapted to this filling condition. A similar course is to be followed when, as a consequence of an undertaken change in quality, such a liquid for dispensing is supplied to the filling machine 10 that compared to the previously dispensed liquid has a different filling characteristic. However, with the respective setting that is to be undertaken of the pressure that is to be regulated, care must be taken that this pressure is not set much below the saturation pressure of the liquid that is to be dispensed in order to avoid detrimental dislodging of the $CO_2$. Generally, the pressure that is to be regulated should correspond to or exceed the saturation pressure. Since each filling element 12 of the filling machine 10 is connected to the return gas chamber 26 that is common for all of the filling elements 12 via its blockable connecting means 64, which is provided with the flow control mechanism 63, each pressure change undertaken at the pressure sensor 33 simultaneously acts upon all of the flow control mechanisms 63 of the filling elements 12. Thus, merely by changing the pressure that is to be regulated, the present invention makes it possible to adapt the flow velocity in a smooth and infinitely variable manner to the respective specifications or dispensing characteristics of the liquid that is to be dispensed. This is of particular advantage for filling machines that are to be used for different beverages and bottle types.

Pursuant to a further specific embodiment of the present invention, it is proposed to use at least a portion of the return gas that is conveyed via the connecting means 64 to the return gas chamber 26 for pressurizing the container and/or for preliminarily rinsing the container prior to pressurization of the latter. This is of economic significance if, accompanied by a low $CO_2$ consumption, liquid introduction is accelerated and is to a large extent effected under the exclusion of air. However, this presupposes that inert gas, for example $CO_2$, is used not only for the pressurizing but also for the preliminary rinsing that might be provided and that precedes the pressurizing. In such a case, it is advisable, for the further use of the return gas, to provide for each filling element 12 a conduit that leads from the connecting means 64, is to be connected to the conduit section 69 downstream of the Venturi tube 65, and is to open into that surface of the base plate 58 that faces the valve disk 52. In addition, the valve disk 52 is to be provided with a connecting conduit so that in an operating position that precedes the actual pressurizing position, for the preliminary rinsing and partial pressurizing, the equalizing channel 60 can be connected to the further conduit that leads from the connecting means 64. In this operating position that is to be provided for the valve disk 52, the preliminary rinsing is effected with the container not yet in the sealing position relative to the filling element 12; when the container is in the sealing position relative to the filling element 12, a partial pressurizing is effected to the pressure that is to be regulated, whereupon only when rotation of the filling element 12 continues is the actual pressurizing effected in that operating position of the valve disk 52 that is provided for this purpose. When the operating position for preliminarily rinsing and partially pressurizing is assumed, the return gas that is at the pressure that is to be regulated passes out of the return gas chamber 26, via the non-illustrated supply channel and the similarly not-illustrated connection channel, into the equalizing channel 60 and from there, via the equalizing chamber 61 and the interior of the filling tube 13, into the container 18. In the latter, the return gas flows upwardly, thereby displacing the air in the container to the outside via the not-yet sealed-off mouth of the container, until, as the filling element 12 continues to rotate, and in so doing the lifting cylinder 16 carries out an upward stroke, the container 18 is brought into the sealing position illustrated in FIG. 2. As the sealing position is assumed, the partial pressurizing of the container is set to the pressure that is to be regulated. If in so doing the danger exists that in order to undertake preliminary rinsing an partial pressurizing so much return gas is taken from the return gas chamber 26 that the pressure that is to be regulated can no longer be maintained with the return gas that is to be supplied to the return gas chamber 26, then in order to maintain this pressure a sufficient quantity of pressurizing gas is to be supplied to the return gas chamber 26, for example via a non-illustrated tie line that could connect the return gas chamber 26, or the extension line 31, to the annular distribution chamber 25 or the pressurizing gas line 29. The tie line can be controlled by the pressure sensor 33, and can also be used to supply the return gas chamber 26 with the pressure that is to be regulated as operational readiness of the filling machine 10 is being established.

It should be noted that the aforementioned embodiments are not just applicable for the described filling machine, which is provided with filling elements 12 that each have a controlled liquid flow valve 48 that can be moved into a closure position as a result of a signal issued by the switching member 49 when the liquid in the container 18 rises to a predetermined level. It is also possible, and is still within the basic concept of the present invention, to close the respective liquid flow valve 48 in response to a signal that is issued by the control mechanism 47 after successful introduction of a given quantity of liquid into the container 18, whereby, however, the liquid flow valves 48 are also adapted to be mechanically moved into a closure position, after which further rising of the liquid in the container is interrupted at the inlet that determines the filling height.

Figure 5:
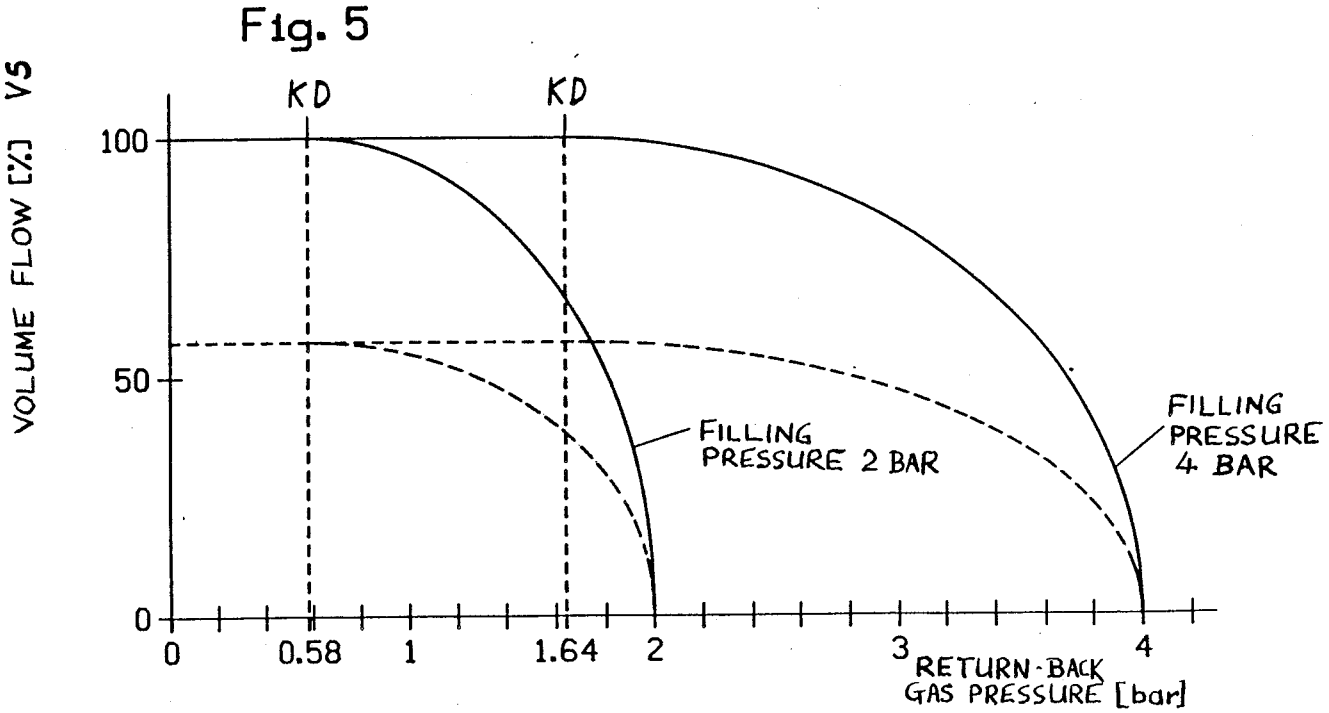
FIG. 5 is a view showing a diagram including a representation of influence of a throttle device upon volume flow (volume per time unit) of return gas.

In this last mentioned case, as shown in FIG. 4, instead of the switching member 49, in a customary manner the inlet 79 of the connecting means 64 is placed in the container 18 that is to be filled for the determination of the filling height, and thereabove in the supplying conduit section 68 in a known manner a ball retaining valve 80 is associated with the container to interrupt the supply of liquid thereto. With this variation, it can also be expedient to mechanically control the discharge valve 66, and to transfer the function thereof to the valve disk 52. FIG. 5 illustrates, for the filling machine, according to FIGS. 1 and 2, in a diagram the representation of the influence of the throttle device 63 upon the volume flow (volume per time unit) of the return gas.

The course or path of the volume flow VS dependent upon return gas pressure in the return gas chamber 26 is set forth in FIG. 5 respectively for two different filling pressures of 2 bar respectively 4 bar in the fluid or liquid line or conduit 28. As shown by FIG. 5, the volume flow VS with a return gas pressure in the return gas chamber 26, which lies below a critical pressure KD, is independent of the return gas pressure and is determined exclusively by the throttle device 63 respectively by the effective cross section of the jets or nozzles 65 and 67 (Venturi tubes).

The present invention is, of course, in no way restricted to the specific disclosure of the specification and drawings, but also encompasses any modifications within the scope of the appended claims.

WHAT I CLAIM IS:

1. A method of filling a carbonated liquid, particularly beverages, into a container under counterpressure, said method comprising the steps of:

preliminarily pressurizing said container with pressurizing gas;

then introducing, via a filling element, said liquid, which is under a filling pressure, into said container when the latter is in a sealing position with respect to said filling element;

during said introducing of liquid into said container, at least for a given period of time, withdrawing from said container, the gas or gas mixture, formed by return gas, that is displaced by said introduced liquid involving a pressure differential between filling pressure of the liquid and the gas or gas mixture in the container under counterpressure, and thereupon conveying said gas or gas mixture into a chamber via a connecting means that is provided with a flow control mechanism, said flow control mechanism including a space having a pressure relationship of gas or gas mixture therein beyond which upon pressure increase at an output from the space of said flow control mechanism the volume flow of return gas displaced from the container by the liquid and passing through the flow control mechanism has an interdependent interrelationship of the pressure with respect to the gas or gas mixture and the liquid;

regulating in said chamber a pressure that is adjustable within a range that is between said filling pressure and the pressure of said flow control mechanism;

interrupting said connecting means upon termination of introduction of liquid into said container; and thereupon reducing the pressure in said container to atmospheric pressure.

2. A method according to claim 1, in which said pressure that is to be regulated in said chamber is at least close to the saturation pressure for said liquid.

3. A method according to claim 1, which includes said regulating of said pressure in said chamber concurrently as a function of said filling pressure of said liquid that is to be disposed.

4. A method according to claim 3, which includes continuously carrying out said regulating of said pressure concurrently as a function of said filling pressure.

5. A method according to claim 4, which further includes the steps of sequentially therewith: effecting said pressure regulating in said chamber via said connecting means, which is disposed between said container and said chamber, for a given period of time at the termination of said liquid introducing and while said container is still in said sealing position with said filling element; and, after said given period of time has elapsed, interrupting said connecting means and undertaking said reduction of pressure in said container.

6. A method according to claim 1, which includes using at least a portion of said gas or gas mixture that is displaced via said connecting means into said chamber for at least one of said preliminary container pressurizing and also a preliminary container rinsing that precedes said preliminary pressurizing.

* * * * *